US005551570A

United States Patent [19]

Shaffer et al.

[11] Patent Number: 5,551,570

[45] Date of Patent: Sep. 3, 1996

[54] DECORATIVE PACKAGING SYSTEM INCLUDING A METHOD AND KIT THEREFOR

[76] Inventors: Pauline S. Shaffer, 28 Viking Dr., Englewood, Colo. 80110; Kathy L. Fisher, 9355 Notts Ct., Littleton, Colo. 80214

[21] Appl. No.: 191,030

[22] Filed: Feb. 2, 1994

[51] Int. Cl.[6] ..... B65D 77/00

[52] U.S. Cl. ..... 206/575; 206/223; 220/410; 383/71; 383/121

[58] Field of Search ..... 206/45.33, 44 R, 206/223, 423, 457, 575; 217/1, 11, 122, 124, 125, 127; 220/9.1, 410; 229/87.06, 87.18, 87.19, 114, 117.11, 914, 922, 923; 383/70, 71, 121; 428/7, 8; 524/91, 100, 108, 96, 349, 448; 568/720, 732

[56] References Cited

U.S. PATENT DOCUMENTS

| | | | |
|---|---|---|---|
| 905,145 | 12/1908 | Brown | 229/923 |
| 3,355,092 | 11/1967 | Le Pain | 229/87.19 |
| 3,512,700 | 5/1970 | Evans et al. | 383/121 |
| 3,804,235 | 4/1974 | Anderson | 206/45.33 |
| 3,894,985 | 7/1975 | Coombs | 524/448 |
| 3,935,281 | 1/1976 | Cottman | 568/732 |
| 3,941,747 | 3/1976 | Roth, Jr. et al. | 524/349 |
| 4,007,157 | 2/1977 | Ramey et al. | 524/100 |
| 4,189,868 | 2/1980 | Tymchuck et al. | 206/423 |
| 4,240,954 | 12/1980 | Stretanski | 524/96 |
| 4,464,496 | 8/1984 | Nemzek et al. | 524/91 |
| 4,501,838 | 2/1985 | Hechenbleikner et al. | 524/108 |
| 4,870,214 | 9/1989 | Mina et al. | 568/720 |
| 5,251,759 | 10/1993 | Gannon et al. | 229/87.19 |
| 5,294,040 | 3/1994 | Cohen et al. | 229/922 |

OTHER PUBLICATIONS

Easter Basket Kit, Highland Manufacturing & Sales, Highland, Illinois, U.S.A.

Gift Basket Shrink-Wrap, Flora International Corp.

*Primary Examiner*—Jimmy G. Foster

*Attorney, Agent, or Firm*—Timothy J. Martin

[57] ABSTRACT

A decorative packaging system and kit for containing and displaying objects, the system including a basket, a flexible bag and a bag closure fastener. The bag is adapted to enclose the bag, and the fastener is adapted to close the mouth of the bag over the handle of the basket. The bag has a bottom that may include a bellows structure. The kit includes a packet that is adapted to receive the bag and fastener therein and that is adapted to be secured on the basket.

14 Claims, 4 Drawing Sheets

DECORATIVE PACKAGING SYSTEM INCLUDING A METHOD AND KIT THEREFOR

FIELD OF THE INVENTION

The present invention generally relates to packaging materials that are used to package objects wherein the packaged objects are displayed in a pleasing manner. More specifically, the present invention concerns packaging of gifts for presentation to others on special occasions. Thus, the present invention is directed to a decorative packaging system, including a kit and method therefor.

BACKGROUND OF THE INVENTION

Gift giving has been a socially accepted practice since the beginning of civilization, and the event generates pleasure for both the recipient of the gift and the giver. Since early times, it has been the practice to present the gift in a pleasing package that is often decoratively wrapped to obscure the nature of the gift. By wrapping the gift, the recipient may then be more surprised by the nature of the gift is revealed when the recipient unwraps it.

Sometimes, however, it is desirable to present the gift in such a manner that the nature of the gift may readily be viewed. One example, among many, is the giving of a basket of fruit, nuts, meats, cheeses, wines, etc. wherein various gift objects are placed within an open container and then given to the intended recipient of the gift. Even when presenting a container of such objects to the recipient, it is still often desirable to somehow wrap the gift to enhance the presentation. The wrapping of the gift completes the thoughtfulness of the giver and adds a quintessential touch to the gift. Rather than obscuring the contents of such a basket of items, though, it is often the practice to wrap this type of gift in a clear or transparent wrap, such as cellophane, polyethylene or other material which may be clear or tinted. This wrap may then be tied with ribbons and bows to create a more festive appearance.

The standard way of gift wrapping a basket of objects is to use a pair of flat panels of the transparent wrap which are placed underneath the container or basket orthogonally to one another. The opposite end portions of each panel are brought upwardly around the handle portion of the container and secured by a ribbon or other fastener so as to encase the container, and the objects contained therein, within the wrap. This technique, however, has several drawbacks. On one hand, it is awkward to employ and requires a fair amount of open space to conduct the wrapping operation. Moreover, the flexible panels are apt to become creased or wrinkled and are subject to static cling which increases the difficulty of wrapping and diminishes the aesthetic appearance of the wrapped gift. Further, once the gift is wrapped, openings are present as a result of the nonjoined edges of the panels so that air, insects, and other contaminants, may intrude within the wrapped region of the gift. These openings also tend to allow the panels to become askew which can detract from the wrapped appearance of the gift. This technique requires time consuming measurements, and often two separate rolls of wrap are employed.

In order to reduce the disadvantages discussed above, and prior to the present invention, there has been limited use of bags to contain gift baskets which in turn hold gift objects to be presented to the recipient of the gift. Typically, these bags are formed by a pair of side panels that are joined on the two side edges and the bottom edge leaving open a mouth so that a basket or other container may be inserted therethrough. The mouth is then secured by means of a ribbon or other fastener so that the bag completely encases the container and the objects placed therein. Sometimes these transparent bags have been printed, but on only one side panel, with a decorative design in an attempt to enhance the appearance of the wrapped gift. These bags do provide certain advantages over the pair of wrapping panels described above, but nonetheless have disadvantages of their own. For example, these bags do not have a bottom panel since the side panels are merely joined to one another. Thus, when a basket or other container is placed therein, a pair of pointed portions, defined by the Juncture of the side edges and bottom edge, with these pointed portions projecting laterally away from the container in an unattractive manner. Furthermore, when printed on one side, it is necessary to carefully orient the back and the container to establish some sort of symmetry for the pattern relative to the container and, especially, the the container is a basket and the handle is used as a bag supporting frame member. Otherwise, the pattern appears misplaced and distracts from the appearance of the wrapped package. Even where properly aligned, the pattern only appears approximately half of the circumference of the package so that this also distracts from the appearance of the presentation of the gift.

Accordingly, there remains a need for improved packaging for gifts in the form of a bag-like wrap which is easier and more convenient to use yet which presents a professional appearance for a wrapped gift. There is need for such a wrap, a method of wrapping a container and a kit which can be implemented simply by ordinary consumers while at the same time providing a professional method and system for commercial use. The present invention addresses these needs.

SUMMARY OF THE INVENTION

It is an object of the present invention to provide a new and useful decorative packaging system, method and kit that is adapted to contain and display objects such as gift items.

It is further an object of the present invention to provide a decorative packaging system which is easy to use and relatively inexpensive so that it may be used by ordinary consumers yet that may still be employed in commercial applications.

Still another object of the present invention is to provide a decorative packaging system and method that is based on a bag-like enclosure yet wherein a decorative design may be presented completely around the packaged gift in a repetitive manner.

Still a further object of the present invention is to provide a packaging system and method which matches a bag-like enclosure and a container for objects to be packaged so as to present an overall neater appearance of the completed package.

Another object of the present invention is to provide a packaging kit which can be used by the ordinary consumer for packaging containers of objects that may be readily viewed and appreciated in a pleasing manner.

According to the present invention, then, a decorative packaging system is provided which is adapted to contain and display objects so that a gift giver may present a gift in an aesthetically pleasing manner. Broadly, this system includes a container that is adapted to receive and support objects placed therein, a flexible bag formed of a transparent material and operative to enclose the container and a fastener which is operative to encircle an outer top margin of the bag to form a closure for the mouth after the container is placed within the bag. Here, the container has a bottom wall and a surrounding sidewall extending upwardly to terminate in a rim defining an opening for the container and a handle extends between opposed portions of the rim in an arch-like manner so as to have a medial handle portion oriented above the rim and positioned in opposed relation to the bottom of the container. When the container is placed within the flexible bag, the bottom wall of the container may be placed on a bottom panel that is preferably formed by a plurality of panel sections which are joined along with lateral side edges of the side panels forming the bag in order to form bellows that more conforms to the shape of the bottom wall. The side panels then provide a more tubular bag side wall which can extend upwardly from the bottom panel to terminate in a mouth through which the container is inserted. The fastener can then be placed about the outer top margin of the bag adjacent the mouth thereby drawing the side panels tautly about the container and the handle with the closure then being supported by the medial portion of the handle.

In the preferred form of the present invention, the bottom panel is formed by a pair of panel sections and these panel sections along with the pair of side panels are integral with one another and are formed as an extruded polypropylene material having a thickness of at least 0.001" (25 microns). Moreover, the outer faces of the side panels are each provided with a decorative design pattern and printed thereon so that the pattern extends completely and circumferentially around the bag. This decorative pattern is formed by a plurality of repetitive design elements preferably imprinted on the bag with a food safe medium. Moreover, it is preferred that the fastener be a ribbon which can be tied around the mouth of the bag.

The present invention therefore contemplates a method of packaging objects for display and presentation which includes a plurality of packaging steps. First, this method includes the step of placing the objects to be packaged in a container that has a bottom wall, a surrounding side wall that extends upwardly to terminate in a rim defining an opening for the container and a handle that extends between opposed portions of the rim in a arch-like manner so as to have a medial handle portion oriented above the rim and positioned in opposed relation to the bottom of the container with the objects being positioned to be viewed in this container. Next, the container is encased with a clear flexible bag formed of a polypropylene material that is provided with a decorative design and printed completely around its outer circumference with this step of encasing the container being accomplished by inserting the container through a mouth of the bag. Finally, the method includes the fastening of the mouth of the bag closed around the container by encircling the mouth with a flexible tie and securing the tie while simultaneously drawing the side panels of the flexible bag tautly about the container and the handle so that the bag is supported at the mouth by the medial portion of the handle.

The packaging system described above, and the method of implementing this packaging system is well suited for commercialization in a kit form. Here, the kit includes a container that is adapted to receive and support objects placed therein, a flexible bag sized and adapted to receive the container and a fastener to secure the bag about the container. More particularly, the container has a bottom wall of a selected geometric shape, a surrounding side wall extending upwardly to terminate in a rim defining an opening for the container and a handle extending between opposed portions of the rim in an arch-like manner so as to have a medial handle portion oriented above the rim and positioned in opposed relation to the bottom of the container. The flexible bag has a pair of side panels joined along lateral side edges, an open mouth and a bottom panel enclosing a bottom end of the bag opposite the open mouth. The base is sided to be positioned to against the bottom panel when the bag is opened such that the side panels extending upwardly beyond the medial portion of the handle to define a top margin for the bag. The fastener is then operative to encircle the top margin of the bag when the container is placed therein and may be closed so as to close the bag and be supported by the medial portion of the handle thereby drawing the side panels of the bag tautly about the container and the handle. To complete the kit, the flexible bag and fastener are received in a packet and the packet is secured to the container.

In the kit form, the bottom panel is again preferably formed to have a plurality of panel sections to form a bellows, as described above so that the bag may be expanded and folded. The folding of the bag allows it to be inserted into the packet. The fastener may be a ribbon received in the packet, the container may be a basket, and the bag may be constructed of polypropylene and may be decorated with a design pattern. Moreover, the bottom of the bag may be of such geometric shape so as to allow the geometric shape of the bottom wall of the container to be inscribed therein.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENT

The present invention is directed to a decorative packaging system along with a method and kit therefor that is particularly suitable to package gift objects such as fruit, nuts, meats, cheeses, wine, etc., in a gift container such as a gift basket. The system, method and kit are based on a new and useful packaging bag which is sized and adapted to receive a container of the objects to be packaged, especially for gift presentation. The present invention is specifically directed to such a system, method and kit wherein the gift wrapping is highly decorative and pleasing in appearance yet which allows ready viewing of the contents of the gift for display purposes. Moreover, the present system, method and kit, according to the exemplary embodiment of the present invention described hereinafter, is both easy and convenient to use by ordinary consumers as well as in commercial applications.

Figure 1:
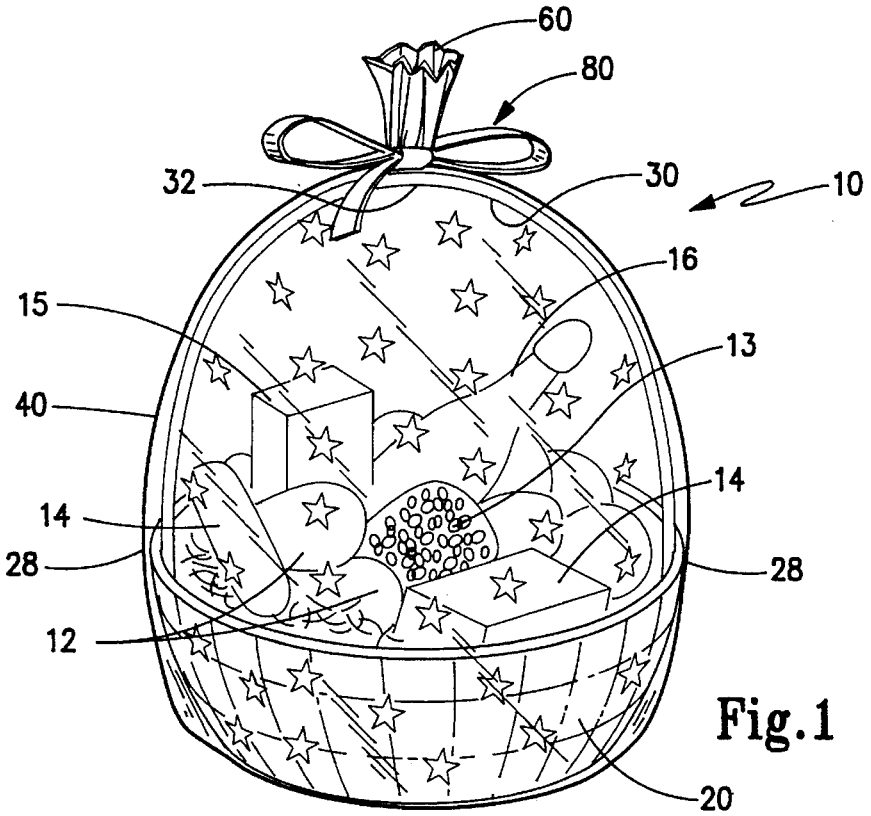
FIG. 1 is a perspective view of a gift basket of objects showing the decorative packaging system of the present invention packaging those objects.

The completed gift according to the exemplary embodiment of the present invention is best shown in completed form in FIG. 1. Here, it may be seen that gift 10 includes a plurality of gift objects such as fruits 12, a package 13 of nuts, packages 14 of meats, cheese 15 and a bottle of wine 16, hereinafter collectively referred to as the "gift items", all received in a gift basket 20 that is wrapped in a flexible bag 40 as hereinafter described. Bag 40 has a mouth 60 that is closed by means of a fastener in the form of ribbon 80 so that mouth 60 is supported by medial portion 32 of handle 30 of basket 20. It should be understood that the various gift items 12–16 are for representative purposes and that any type of gift items of a size capable of being received and supported by basket 20 can be packaged in a decorative packaging system according to the present invention.

Figure 2:
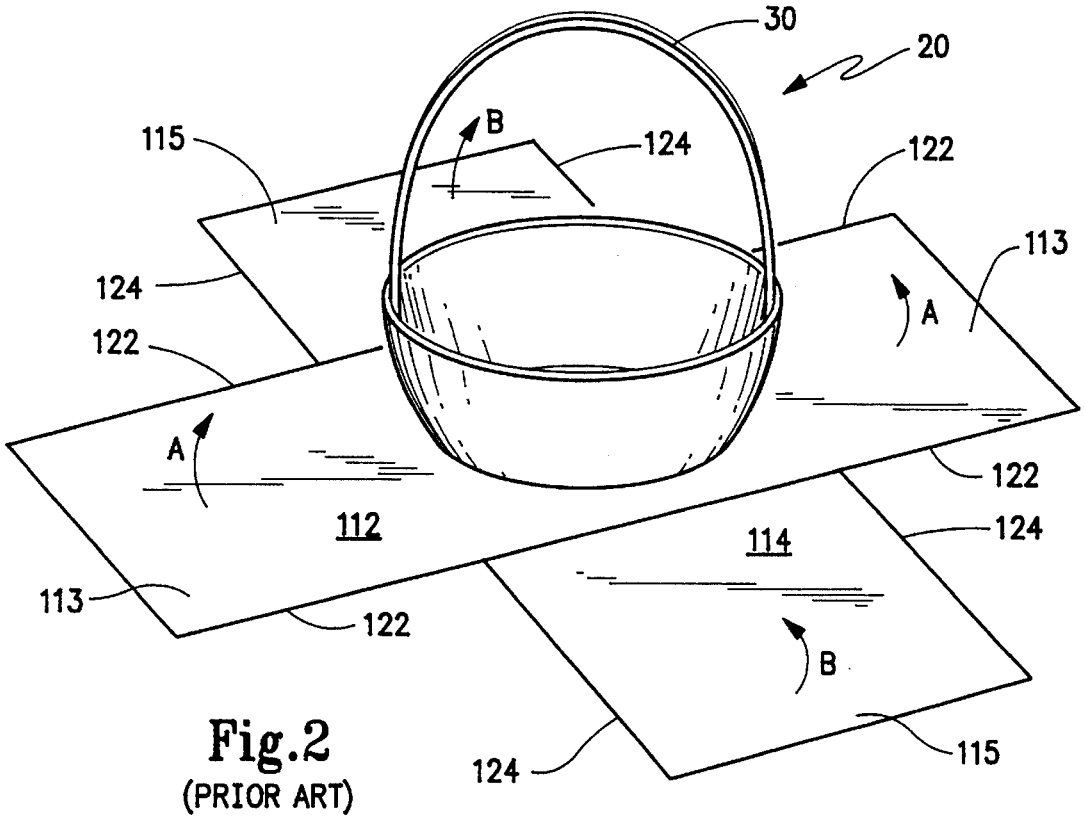
Fig.2 (PRIOR ART)
FIG. 2 is a perspective view of a first prior art technique for packaging objects.

Before further discussing the exemplary embodiment of the present invention, it is perhaps helpful to review the two principal existing ways of providing a decorative packaging system adapted to be used with container such as basket 20. With reference to FIG. 2, then, it may be seen that one typical way of wrapping basket 20 is to provide a pair of sheets or panels 112, 114 of approximately twice the height of basket 20, as measured between its base and its handle, with the panels 112 and 114 being laid flat and orthogonal to one another underneath the basket 20. Panels 112 and 114 are formed of a transparent wrap material such as a polyethylene or cellophane substance. To wrap basket 20, as is shown in FIG. 2, the opposite end portions 113 of panel 112 are wrapped upwardly around handle 30 in the direction of arrows "A" and are held in position at this location. Next, the opposite end portions 115 of panel 114 are wrapped upwardly, in the direction of arrows "B" after which the end portions 113 and 115 are secured to one another by means of a ribbon or other fastener. It should be readily understood that this technique leaves four gaps, between side edges 122 of panel 112 and side edges 124 of panel 114, respectively. Further, it is easy for panels 112 and 114 to become askew with respect to one another which creates a very unpleasing package. The technique, of course, requires a suitable flat space upon which to lay panels 112 and 114 and is relatively time consuming and inconvenient.

Figure 3:
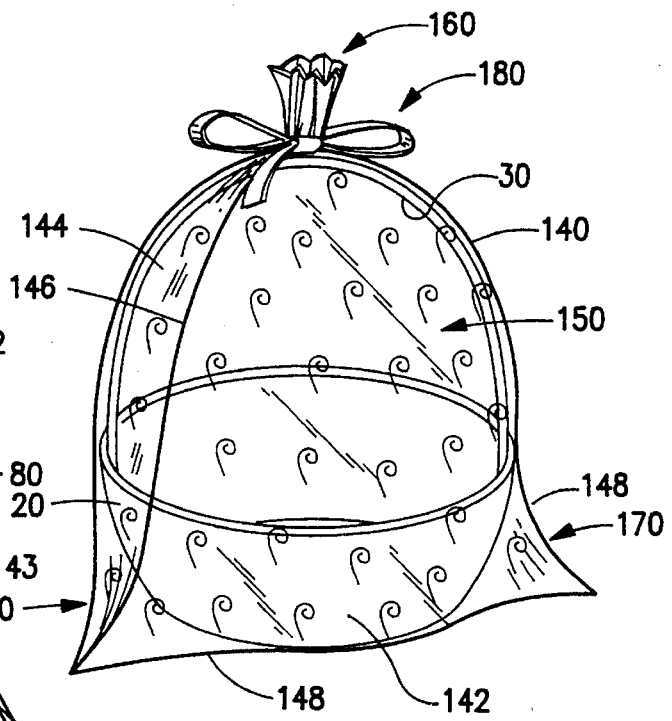
Fig.3 (PRIOR ART)
FIG. 3 is a perspective view of a second prior art technique for packaging objects.

A second type of packaging found in the prior art is illustrated in FIG. 3. Here, a bag 140 receives basket 20. Bag 140 is formed by a first side panel 142 provided with a decorative pattern 150, and a second side panel 144 which is not printed with the decorative pattern. Side panels 142 and 144 are joined to each other along side seams 146 and along a bottom seam 148 so as to have an open mouth 160. Mouth 160 is then secured around handle 130 of basket 120 by means of a ribbon fastener 180. Two disadvantages of bag 140 are readily apparent in FIG. 3. With the construction described above, two pointed, pouch portions 170 reside at the corners of bag 140 defined by the junction of bottom edge seam 148 with side seams 146, and 148 respectively. The existence of these corner portions 170 detract from the overall appearance of the completed gift package. Moreover, as is seen in FIG. 3, unless bag 140 is properly aligned, then the decorative pattern 150 will be relatively rotated so as not to be symmetric with respect to handle 30 of basket 20 which further detracts from the overall appearance of the completed package.

Figure 4:
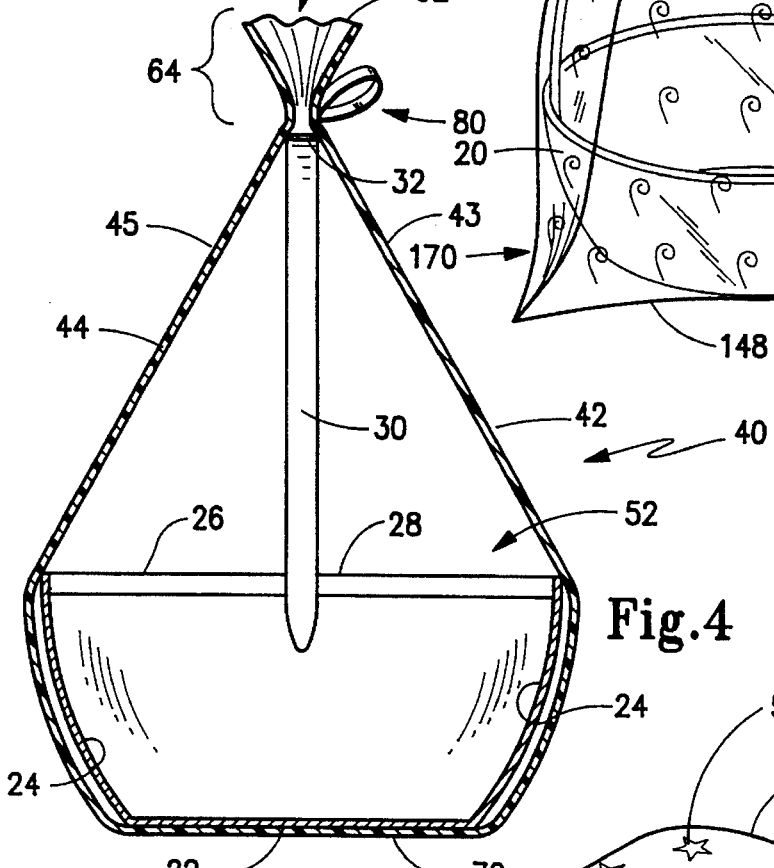
FIG. 4 is a cross-sectional view of the decorative packaging system according to the present invention.
Figure 5:
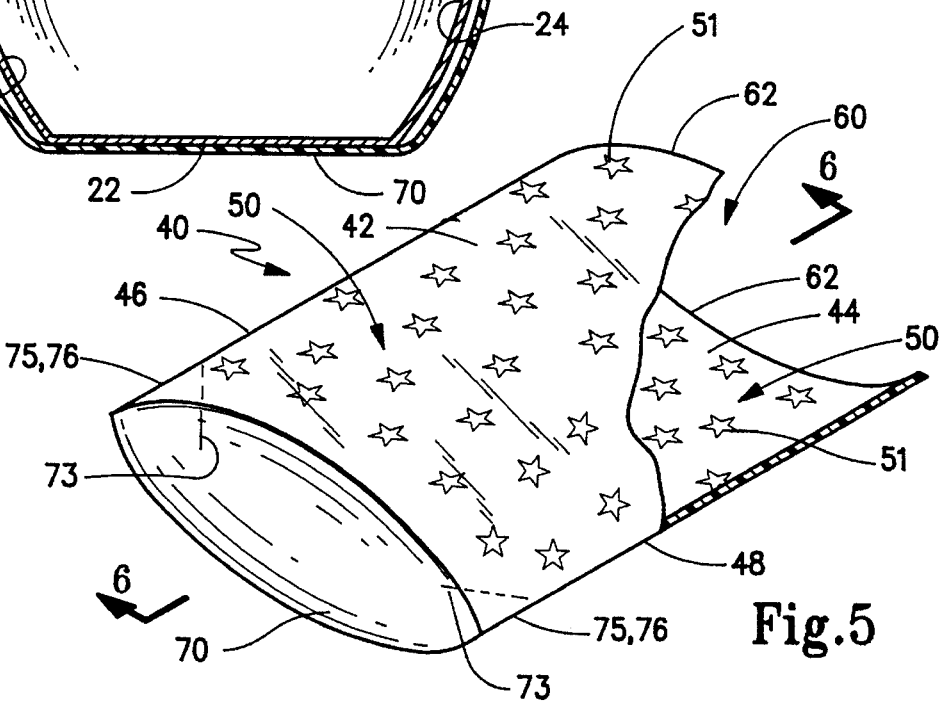
FIG. 5 is a perspective view of the flexible bag according to the preferred embodiment of the present invention.
Figure 6:
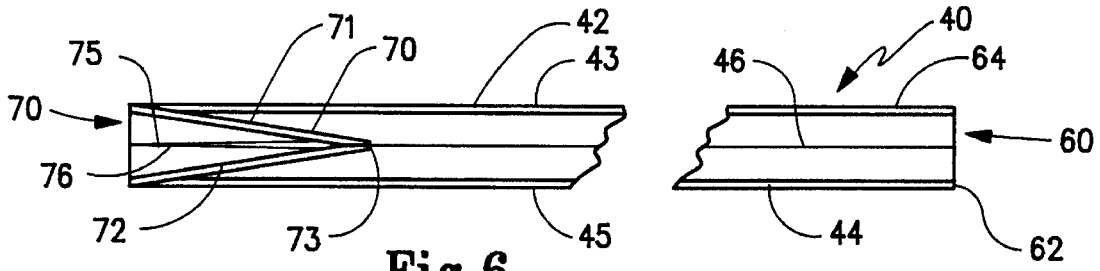
FIG. 6 is a cross-sectional view taken about lines 6—6 of FIG. 5.
Figure 7A:
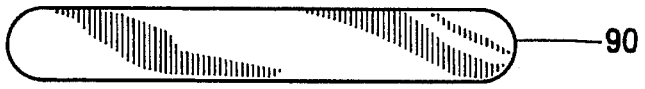
FIG. 7(*a*)–7(*d*) are diagrammatic views showing the construction steps used to produce the flexible bag shown in FIG. 5.
Figure 7B:
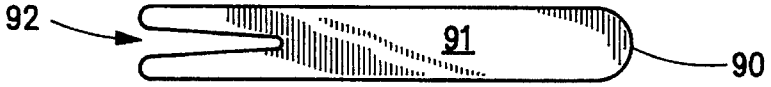
Figure 7C:
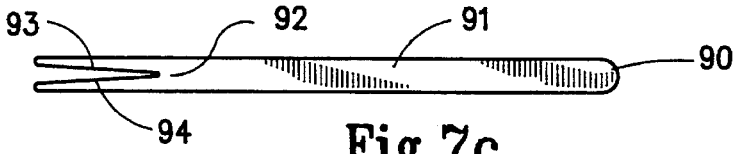
Figure 7D:
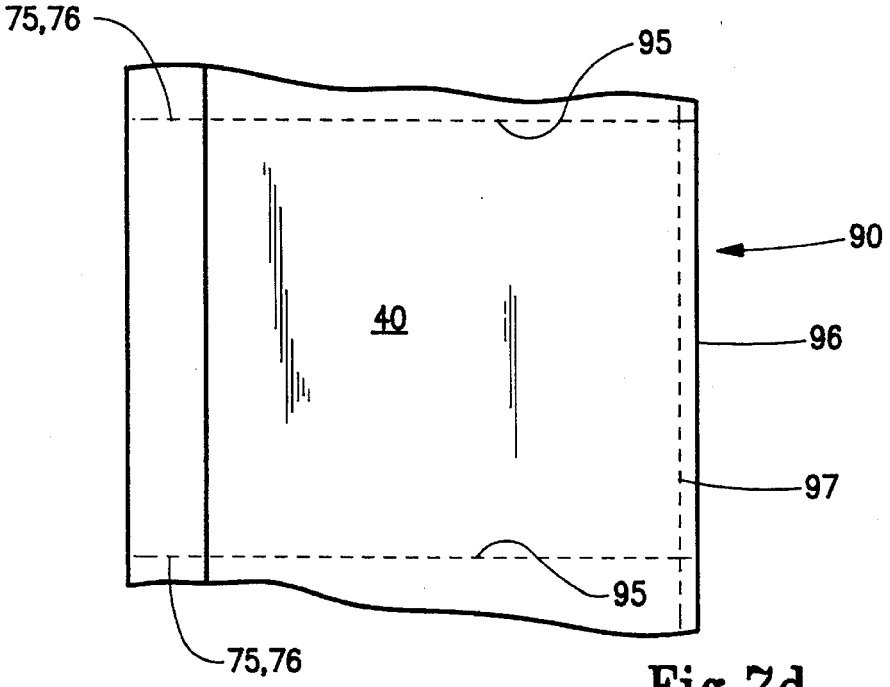

The preferred embodiment of the present invention addresses the disadvantages of the prior art techniques shown in FIGS. 2 and 3 by providing specially constructed bag 40 shown in FIG. 1 and in FIGS. 4–6. Here, it may be seen that bag 40 is constructed out of a flexible material and has a pair of side panels 42 and 44 which are joined along side seams 46 and 48 so as to define an open mouth 60 thus shown in FIG. 4. With reference to FIGS. 4–6, it may be seen that side panel 42 that has an outer face 43 and side panel 44 has an outer face 45; and faces 43 and 45 are imprinted with a decorative design 50 shown in FIG. 5 to be a plurality of repetitive stars, such as stars 51. Mouth 60 is defined by the edge 62 of bag 40 so that a mouth margin or top margin 64 is located adjacent edge 62. This top margin 64 is adapted to be closed by ribbon fastener 80.

With reference again to FIGS. 4–6, it may be seen that bag 40 includes a bottom panel 70 that is adapted to be placed against bottom wall 22 of basket 20. Bottom panel 70 is formed by a pair of panel sections 71 and 72 folded along fold line 73. Moreover, each of panel sections 71 and 72 have opposite lateral end edges 75 and 76, respectively, which are joined together with lateral side edges 46 and 48 of side panels 42 and 44. This structure, best shown in FIGS. 5 and 6, may be referred to as a bellows structure in the bag art. Preferably, bag 40 is formed of a polypropylene material which differs from prior art polyethylene bags and has distinct advantages over polyethylene bags. By fabricating flexible bag 40 out of polypropylene, one obtains a bag that is longer in shelf life and is more resistant to changes in its clarity. Preferably, the thickness of flexible bag 40 is at least 0.001" (25 microns), with the preferred bag 40 being described herein having a thickness of 0.0015" or 1.5 mils (35–40 microns).

With reference to FIGS. 1 and 4, it may be seen that bag 40 is sized and adapted to receive a container, such as basket 20, in its interior 52. Here it may be seen that basket 20, for representative purposes, has a bottom wall 22 with surrounding side wall 24 extending upwardly therefrom to terminate in a rim 26 that defines an opening for basket 20. Handle 30 then extends between opposed portions 28 of rim 26 in an arch-like manner so as to have a medial handle portion 32 oriented above rim 26 and positioned in opposed relation to bottom wall 22 of basket 20.

As noted, it is important to match the size of the container or basket 20 to the size of the bag 40 so that basket 20 may be received entirely within interior 52 with top margin 54 extending to eight inches (10–20 cm) above medial portion 32 of handle 30. This is true whether the base of basket 20 is square, circular, oval etc. Ribbon fastener 80 may then be operative to encircle the outer top or mouth margin of bag 40 adjacent to mouth 60 when basket 20 is placed therein. When fastener ribbon 80 is secured, it operates to form a closure for mouth 60 of bag 40 that is supported by medial portion 32 of handle 30. When secured, ribbon fastener 80 allows the user to draw side panels 42 and 44 tautly around basket 20, and specifically front wall 22 and surrounding side wall 24 so that it is held in a taut condition by medial portion 32.

By providing bottom panel 70 with a bellows defined by bottom panel section 71 and 72, the bellows may expand to more readily configure to the shape of bottom wall 22 thereby eliminating pointed pouch portions 170 shown in FIG. 3. This bellows moreover allows bag 40 to be flattened into a flat state wherein side panels 42 and 44 are parallel to and adjacent to one another with the bellows folded. It also allows the bag 40 to be expanded into an open state wherein side panels 42 and 44 are spaced apart from one another with the bellows unfolded.

With reference to FIG. 5, it may be seen that side panels 42 and 44, when in the expanded state, form a tubular construction having a circumference extending around faces 43 and 45 thereof. Decorative design 50 is printed circumferentially and completely around bag 40. Preferably, the decorative design elements, such as stars 51, define a repetitive pattern. This eliminates the disadvantage of skewing bag 40 relative to basket 20 which was illustrated in the prior art of FIG. 3. Accordingly, should bag 40 slightly rotate relative to basket 20, the decorative pattern 50 maintains its pleasing appearance. Therefore, this construction eliminates the criticality of orienting the basket in the bag which results in time savings. This is important especially where bag 40 is constructed of a flexible tinted or untinted material. Furthermore, since often the gift items, such as items 12–16, are food products, it is preferable to print the design elements forming decorative pattern 50 with a food safe medium, such as low lead, food safe ink.

Turning to FIGS. 7(*a*)–7(*d*), a construction method for bag 40 is described. Here, a tube 90 of polypropylene material is extruded into a somewhat flattened shape, as is shown in FIG. 7(*a*). A circumferential portion 92 is folded into the interior 91 of tube 90 as is shown in FIG. 7(*b*), and, as shown in FIG. 7(*c*), this configuration is then further flattened. It should be understood that the folding of portion 92 in a manner shown in FIG. 7(*a*) and 7(*c*) is to provide the bellows structure, described above. Thus, tube portions 93 and 94 are provided to form bottom panel sections 71 and 72, respectively. As is seen in 7(*d*), which is a top plan view of tube 90 shown in FIG. 7(*c*), it may be appreciated that tube 90 may be sealed and severed, for example by a hot wire, along seal and sever lines 95 to simultaneously form side seams 46, 48, 75, and 76 for bag 40. Edge 96 is cut along cut line 97 immediately adjacent thereto to form mouth 60, all as is known in the art.

From the foregoing, it should now be appreciated that the present invention provides a method of packaging objects for display and presentation as a gift comprising a plurality of steps. This method comprises the first step of placing the objects in a container, such as basket 20, that has a bottom wall, a surrounding side wall extending upwardly to terminate in a rim defining an opening for the container and which has a handle extending between opposed portions of the rim in an arch-like manner so as to have a medial portion oriented above the rim and positioned in opposed relation to the bottom of the container with the objects being positioned to be viewed in the container. Next, the method includes the step of encasing the container interiorly within a clear flexible bag formed of polypropylene material that is provided with a decorative design and printed completely around its outer circumference, this step of encasing being accomplished by inserting the container through a mouth of the bag. Finally, the method according to the present invention includes the step of fastening the mouth of the bag closed around the container by encircling the mouth with a flexible tie and securing the tie while simultaneously drawing the side panels of the bag tautly about said container and said handle so that the bag is supported at the mouth by the medial portion of the handle.

Figure 8:
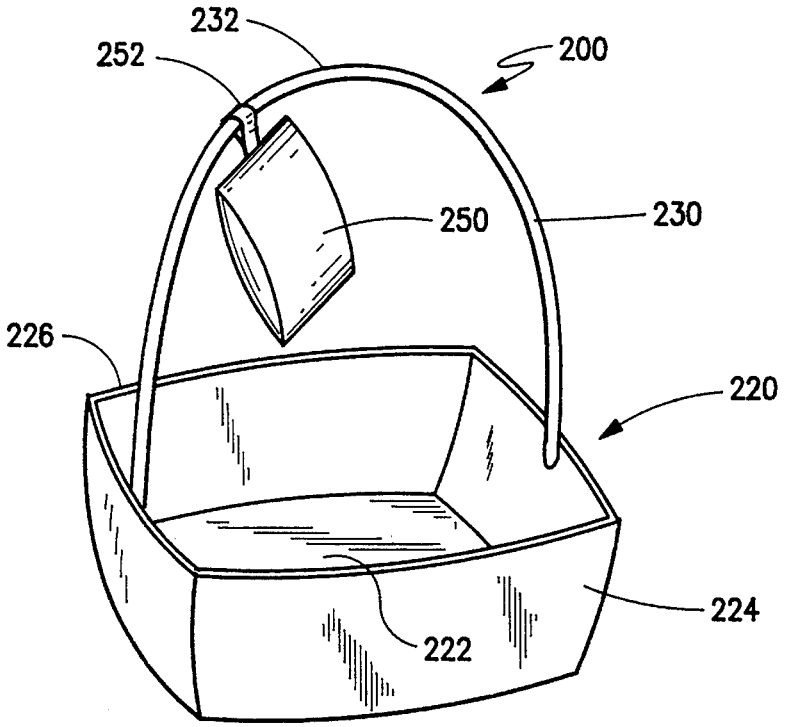
FIG. 8 is a side view in elevation showing the present invention in kit form.
Figure 9:
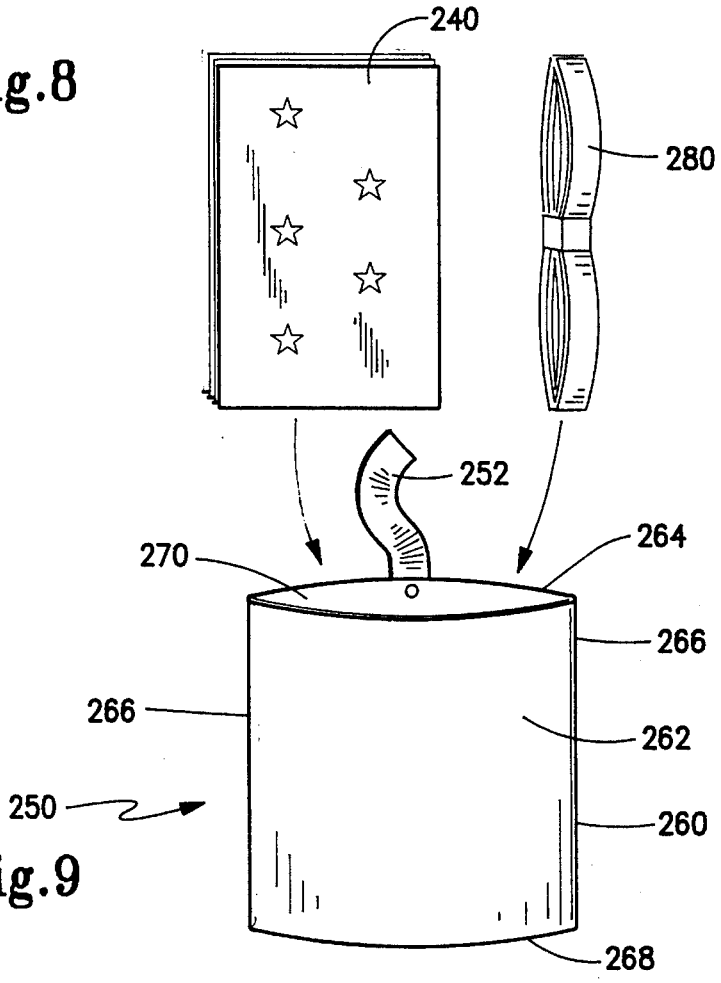
FIG. 9 is an exploded view of the bag and ribbon elements used in the kit of FIG. 8 shown for insertion into the packet.

Further, from the foregoing, it should be appreciated that the present invention may be conveniently commercialized in kit form. With reference to FIGS. 8 and 9, it may be seen that the packaging kit 200 includes a container in the form of a basket 220 having a bottom wall 222 of a selected geometric shape. It may be seen in FIG. 8 that bottom wall 222 is more rectangular than the more circular geometric shape of bottom wall 22 of basket 20. Upstanding side wall 224 extends upwardly from bottom wall 222 to terminate in a rim 226 that defines an opening for container or basket 220. A handle 230 extends between opposed portions of rim 226 in an arch-like manner so as to have a medial handle portion 232 oriented above the rim and positioned in opposed relation to the bottom of the container.

As is seen in FIG. 8, a packet 250 is secured by means of a retaining element 252 on basket 220 and, more specifically, on medial portion 232 of handle 230. Packet 250 is best shown in FIG. 9 and is formed as an enclosure or housing 260 having a front wall 262 and a back wall 264 that are joined along edges 266 and bottom 268. Housing 260 has an open mouth 270 into which a flexible bag of the type described above may be inserted. Thus, with reference to FIG. 9, it may be seen that bag 240, which is substantially the same as bag 40 described above, and a ribbon 280 may be placed and sealed. Kit 200 may then be completed by attaching a packet 250 by means of retaining element 252 onto handle 230. This product can then readily be commercialized in this kit form.

Accordingly, the present invention has been described with some degree of particularity directed to the exemplary embodiments of the present invention. It should be appreciated, though, that the present invention is defined by the following claims construed in light of the prior art so that modifications or changes may be made to the preferred embodiment of the present invention without departing from the inventive concepts contained herein.

We claim:

1. A decorative packaging system adapted to contain and display objects, comprising in combination:

(a) a container adapted to receive and support objects placed therein and having a bottom wall, a surrounding sidewall extending upwardly to terminate in a rim defining an opening for said container, and a handle extending between opposed portions of said rim in an arch-like manner so as to have a medial handle portion oriented above said rim and positioned in opposed relation to the bottom of said container;

(b) a flexible bag having a pair of side panels joined along lateral side edges thereof, an open mouth and a bottom panel enclosing a bottom end of said bag opposite the mouth, said bottom panel formed into a plurality of panel sections having opposite lateral end edges joined with each other and joined to respective ones of said lateral side edges along a partial length of said lateral side edges wherein said bottom panel provides a bellows whereby said bag may be flattened into a flat state wherein said side panels are adjacent one another with said bellows folded yet whereby said bag may be expanded into an open state wherein said side panels are spaced apart from one another and said bellows unfolded so that said container may be placed in said bag through the mouth thereof, said bag formed of a relatively clear material and sized and adapted so that said base may be positioned against the bottom panel when in the open state; and (c) a fastener operative to encircle an outer top margin of said bag adjacent to the mouth when said container is placed therein and thereby operative to,form a closure for the mouth of said bag that is supported by the medial portion of said handle while drawing said side panels tautly about said container and said handle.

2. A decorative packaging system according to claim 1 wherein said bag is constructed of polypropylene.

3. A decorative packaging system according to claim 2 wherein said side panels and said bottom panels have a thickness of at least 0.001 inches (25 microns).

4. A decorative packaging system according to claim 1 wherein said side panels each have outer faces, and including a decorative design pattern imprinted on both of said faces circumferentially and completely around said bag.

5. A decorative packaging system according to claim 4 wherein said decorative pattern is formed by a plurality of design elements imprinted in a repetitive pattern.

6. A decorative packaging system according to claim 4 wherein said decorative pattern of design elements is imprinted with a food safe medium.

7. A decorative packaging system according to claim 1 wherein said fastener is a ribbon.

8. A decorative packaging system according to claim 1 wherein said container is a basket.

9. A kit adapted to provide decorative packaging for use with a basket that is operative to receive objects whereby said objects may be packaged for viewing and presentation, comprising:

(a) a basket adapted to receive and support objects placed therein and having a bottom wall of a selected geometric shape, a surrounding sidewall extending upwardly to terminate in a rim defining an opening for said container, and a handle extending between opposed portions of said rim in an arch-like manner so as to have a medial handle portion oriented above said rim and positioned in opposed relation to the bottom of said container;

(b) a flexible bag having a pair of side panels joined along lateral side edges thereof, an open mouth and a bottom panel enclosing a bottom end of said bag opposite the mouth, said bag formed of a relatively clear material and sized and adapted so that said bottom wall may be positioned against the bottom panel when in the open state with said side panels extending upwardly beyond the medial portion of said handle to define a top margin for said bag;

(c) a fastener operative to encircle the top margin of said bag when said basket is placed therein and thereby operative to form a closure for the mouth of said bag that is supported by the medial portion of said handle while drawing said side panels tautly about said basket and said handle; and (d) a packet, said bag being received in said packet, said packet being secured to said basket.

10. A kit according to claim 9 wherein said bottom panel is formed of a plurality of panel sections having opposite lateral end edges joined with each other and with said lateral side edges whereby said bottom panel provides a bellows whereby said bag may be flattened into a flat state wherein said side panels are adjacent one another with said bellows folded yet whereby said bag may be expanded into a open state wherein said side panels are spaced apart from one another and said bellows unfolded so that said container may be placed in said bag through the mouth thereof.

11. A kit according to claim 9 wherein said fastener is a ribbon.

12. A kit according to claim 9 wherein said bag is constructed of polypropylene.

13. A kit according to claim 9 wherein said side panels each have outer faces, and including a decorative design pattern imprinted on both of said faces circumferentially and completely around said bag.

14. A kit adapted to provide decorative packaging for use with a container of objects whereby said objects may be packaged for viewing and presentation, comprising:

(a) a container adapted to receive and support objects placed therein and having a bottom wall of a selected geometric shape, a surrounding sidewall extending upwardly to terminate in a rim defining an opening for said container, and a handle extending between opposed portions of said rim in an arch-like manner so as to have a medial handle portion oriented above said rim and positioned in opposed relation to the bottom of said container;

(b) a flexible bag having a pair of side panels joined along lateral side edges thereof, an open mouth and a bottom panel enclosing a bottom end of said bag opposite the mouth, said bag formed of a relatively clear material and sized and adapted so that said bottom wall may be positioned against the bottom panel when in the open state with said side panels extending upwardly beyond the medial portion of said handle to define a top margin for said bag;

(c) a fastener operative to encircle the top margin of said bag when said container is placed therein and thereby operative to form a closure for the mouth of said bag that is supported by the medial portion of said handle while drawing said side panels tautly about said container and said handle; and (d) a packet sized and adapted to receive said bag and said fastener, said packet being secured to said handle.

* * * * *

US005551570B1

REEXAMINATION CERTIFICATE (3891st)

United States Patent [19] [11] B1 5,551,570

Shaffer et al. [45] Certificate Issued Oct. 5, 1999

[54] DECORATIVE PACKAGING SYSTEM INCLUDING A METHOD AND KIT THEREFOR

[75] Inventors: Pauline S. Shaffer, Englewood; Kathy L. Fisher, Littleton, both of Colo.

[73] Assignee: Tartan Paper Products, Englewood, Colo.

Reexamination Request:
No. 90/004,784, Oct. 3, 1997

Reexamination Certificate for:

| | |
|---|---|
| Patent No.: | **5,551,570** |
| Issued: | **Sep. 3, 1996** |
| Appl. No.: | **08/191,030** |
| Filed: | **Feb. 2, 1994** |

[51] Int. Cl.[6] ..... B65D 77/00

[52] U.S. Cl. ..... 206/575; 206/223; 383/71; 383/121

[58] Field of Search ..... 40/299.01, 308; 206/223, 232, 542, 575; 220/23.86, 23.83, 503, 505, 737, 751, 756, 890; 383/6–9, 13, 15, 24–26, 29; 217/122, 125

[56] References Cited

U.S. PATENT DOCUMENTS

| | | | |
|---|---|---|---|
| 2,265,075 | 12/1941 | Knuetter . | |
| 2,283,069 | 5/1942 | Knuetter . | |
| 3,197,118 | 7/1965 | Meyerhoefer . | |
| 3,437,258 | 4/1969 | Kugler . | |
| 3,438,567 | 4/1969 | Bell, Jr. . | |
| 3,558,039 | 1/1971 | Schmidt | 383/15 |
| 3,935,993 | 2/1976 | Doyen et al. . | |
| 3,980,225 | 9/1976 | Kan . | |
| 4,055,109 | 10/1977 | Kan . | |
| 4,353,497 | 10/1982 | Bustin . | |
| 4,768,818 | 9/1988 | Kolic . | |
| 4,837,849 | 6/1989 | Erickson et al. . | |
| 5,059,036 | 10/1991 | Richison . | |
| 5,184,896 | 2/1993 | Hammond . | |

OTHER PUBLICATIONS

Bleyer Industries Inc, 1975 Easter Catalog (1 Page).
Bleyer Industries Inc, 1976 Easter Catalog.
Bleyer Industries Inc., 1985 Easter Catalog.
Bleyer Industries Inc, 1986 Easter Catalog.
Bleyer Industries Inc., 1987 Easter Catalog.
Bleyer Industries Inc., 1988 Easter Catalog.

*Primary Examiner*—Jimmy G. Foster

[57] ABSTRACT

A decorative packaging system and kit for containing and displaying objects, the system including a basket, a flexible bag and a bag closure fastener. The bag is adapted to enclose the bag, and the fastener is adapted to close the mouth of the bag over the handle of the basket. The bag has a bottom that may include a bellows structure. The kit includes a packet that is adapted to receive the bag and fastener therein and that is adapted to be secured on the basket.

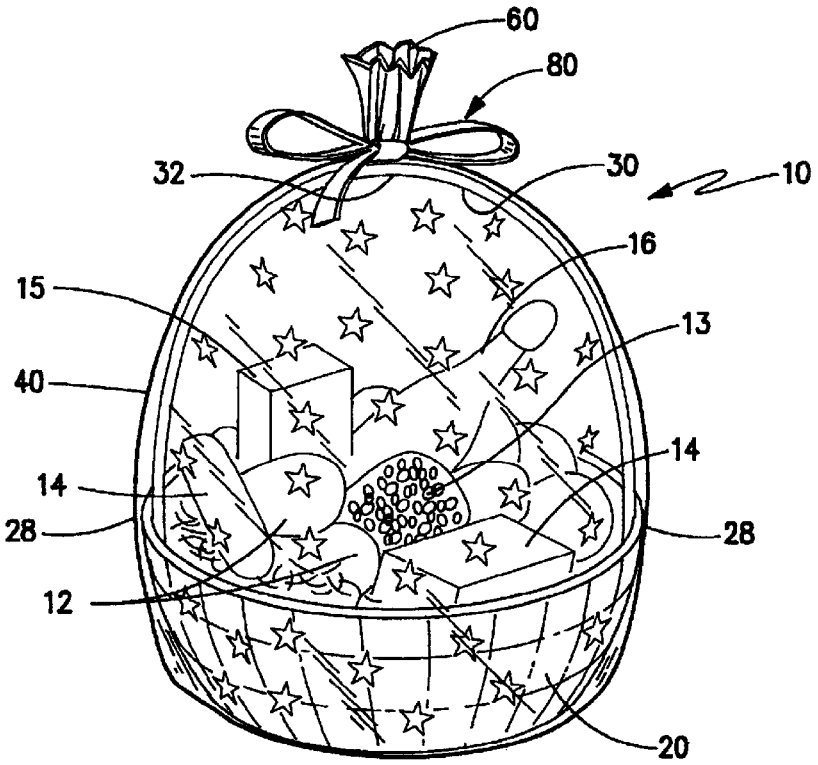

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9–14 is confirmed.

Claims 1–8 are cancelled.

* * * * *